United States Patent [19]

Norin

[11] Patent Number: 4,614,107

[45] Date of Patent: Sep. 30, 1986

[54] TOOL

[75] Inventor: Mats Norin, Älvdalen, Sweden

[73] Assignee: Pressmaster Tool AB, Alvdalen, Sweden

[21] Appl. No.: 705,633

[22] Filed: Feb. 26, 1985

[30] Foreign Application Priority Data

Feb. 27, 1984 [SE] Sweden ..... 8401062

[51] Int. Cl.[4] ..... B21D 41/00

[52] U.S. Cl. ..... 72/402; 72/410; 81/349

[58] Field of Search ..... 72/402, 412, 452; 81/300, 304, 342, 349; 29/200 H, 203 H, 203 HC, 28, 282

[56] References Cited

U.S. PATENT DOCUMENTS

| | | | |
|---|---|---|---|
| 3,177,695 | 4/1965 | Van Oort | 72/402 |
| 3,181,339 | 5/1965 | Esser | 72/402 |
| 3,226,968 | 1/1966 | Holmes | 72/402 |
| 3,459,029 | 8/1969 | Rosenfeld et al. | 72/402 |
| 3,706,219 | 12/1972 | Hoffman et al. | 72/402 |
| 4,308,744 | 1/1982 | Baker | 72/402 |

FOREIGN PATENT DOCUMENTS 1289949 2/1962 France .

1522144 10/1974 United Kingdom .

*Primary Examiner*—W. D. Bray

*Attorney, Agent, or Firm*—Fleit, Jacobson, Cohn & Price

[57] ABSTRACT

A crimping tool includes at least three crimping jaws guided for displacement in a tool body. The jaws present first, second and third straight jaw surfaces, wherewith the first jaw surfaces together define a crimping opening. The first jaw surface on each jaw is constantly in slidable abutment with the second jaw surface of an adjacent jaw. The third jaw surfaces abut against and are movable along a respective straight guide surface formed in the tool body. These guide surfaces or extensions thereof define, when projected onto a plane extending at right angles to all guide surfaces, a polygon having the same number of sides as there are jaws present. The first, second and third jaw surfaces of each jaw or their extensions define a triangle, when projected onto said plane. The guide surfaces are so directed that a corner of each jaw, defined by the first and second jaw surfaces thereof, upon movement of the third jaw surface of the jaw along an associated guide surface moves along a plane which extends parallel with the guide surface and falls at right angles to the plane of the polygon and passes through the geometric center of gravity thereof.

11 Claims, 8 Drawing Figures

TOOL

The present invention relates to a crimping tool, and in particular to a tool for crimping contact sleeves or cable shoes onto electrical conductors, said tool comprising at least three crimping jaws which are guided for displacement in a tool body and each of which presents straight first and second jaw surfaces extending from one corner and forming angles with one another, of which jaw surfaces said first jaw surfaces together define a crimping opening, said first jaw surface on each jaw slidably abutting said second jaw surface of an adjacent jaw, and in which tool each of the jaws with a third straight jaw surface abuts against and is movable along a respective straight guide surface formed in the tool body, while maintaining abutment between the first and second jaw surfaces, therewith to increase and decrease the sectional area of the crimping opening.

One object of the invention is to provide in a crimping tool of a known kind (cf. for example French Patent Specification No. 1,289 949) provided with crimping jaws which upon relative movement therebetween to alter the sectional area of the crimping opening are guided in said movement by one another and by guide surfaces located on the tool body, a noel and improved arrangement through which all jaws are caused to actively take part in a crimping action so that, for example, a contact sleeve or cable shoe crimped on an electric conductor with the aid of the tool is acted upon substantially uniformly from all sides in an advantageous manner.

To this end it is proposed in accordance with the invention that in the case of a tool of the kind mentioned in the introduction the aforesaid guide surfaces or geometric extensions thereof projected onto a plane extending at right angles to all guide surfaces define a polygon having the same number of sides as there are jaws; that said first, second and third jaw surfaces of each jaw or their geometric extensions projected onto said plane define a triangle; and that the guide surfaces are so directed that said corner of each jaw upon movement of the third jaw surface thereof along an associated guide surface moves along a plane which extends parallel with said guide surface and falls at right angles to the plane of the polygon and passes through the geometric centre of gravity thereof.

Further characteristics of the invention are set forth in the depending claims and advantages afforded by the invention are made apparent in the following description, given with reference to the accopanying drawings.

Figure 1:
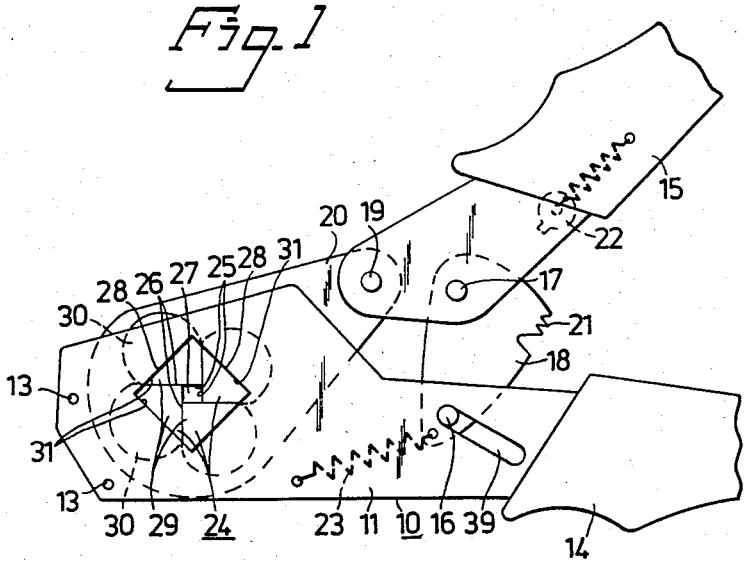
FIGS. 1 and 2 illustrate in side view the forward part of a crimping tool according to the invention, with the crimping jaws in the open and fully closed position, respectively.
Figure 2:
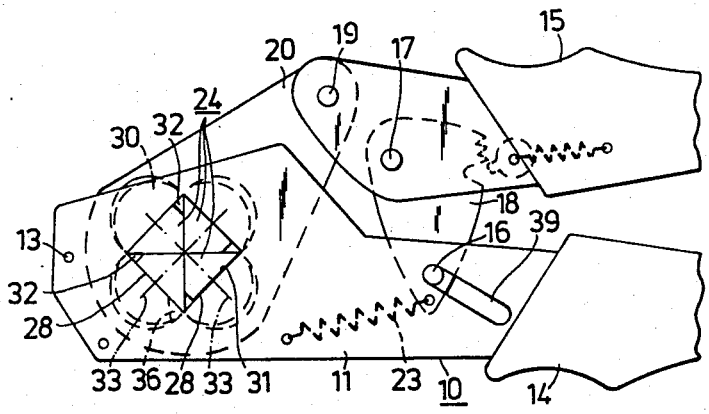
Figure 8:
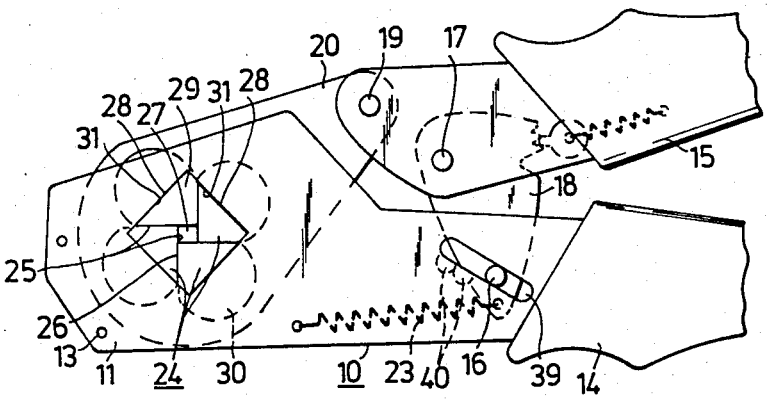
FIG. 8 is a side view similar to that of FIGS. 1 and 2 and illustrates the operation of an arrangement for restricting the force exerted by the crimping jaws.

The crimping tool illustrated in the drawings includes a tool body, generally referenced 10, which is composed of two laterally spaced and mutually parallel parts 11, 12 of which one obscures the other in FIGS. 1, 2 and 8 and which are held together by rivets, screws or like fasteners 13. The tool includes a first and a second handle 14, 15 which are pivotally connected to a link 18 joining said handles with the aid of pivot studs 16, 17. The handle 15 is pivotally connected via a pivot stud 19 to a rotatable cam means 20, described in more detail hereinafter, at a location forward of the pivot stud 17. The reference 21 identifies an arrangement of teeth on the link 18, while reference 22 identifies a pawl rotatably mounted on the handle 15, said pawl preventing in a known manner, the handles 14, 15 from swinging apart, in a direction away from one another, prior to the handles having completed a given pivoting movement towards one another (cf. for example GB Patent Specification No. 1 522 144). The reference 23 identifies a tension spring operative between the tool body 10 and the link 18, this spring endeavouring to swing the handles 14, 15 apart to the position illustrated in FIG. 1. The tool comprises four crimping jaws 24, each of which presents a first and a second jaw surface 25 and 26, respectively, which meet in a right-angled corner, the arrangement being such that the first jaw surface 25 on each jaw always abuts the second jaw surface 26 of an adjacent jaw. The jaw surfaces 25 together define a crimping opening 27 of square sectional area, it being possible to reduce the area of the opening by swinging the handle 15 towards the handle 14, as will be seen when comparing FIG. 1 with FIG. 2.

The jaws 24 present lateral projections 29 defined substantially by the two surfaces 25 and 26 of respective jaws and a third, straight surface 28 thereof, said lateral projections being received in recesses or openings in parts 11, 12 of the toolbody 10, while residual parts 30 of the jaws 24 are accommodated in the space between the parts 11, 12. Each of the surfaces 31 defining these recesses or openings form a guide surface for a respective one of said third jaw surfaces 28 and when projected onto a plane extending at right angles to all surfaces 31, e.g. the plane of the drawing, define a polygon having a number of sides equal to the number of jaws 24 present. Thus, the polygon has four sides and is equilateral and regular, so as to have the form of a square.

As will best be seen from FIG. 2, each lateral projection 29, projected onto said plane, has the basic form of a triangle, the base of which coincides with one side of said polyon and the remaining sides of which are formed by lines extending between the ends of the polygon and its geometric centre of gravity. One of the corner portions of each triangle or lateral projection 29, however, is removed so as to obtain areas or regions 32 having the same level as the jaw parts 30. In this way the jaw surfaces 28 will be shorter than the length of an associated polygon side or guide surface 31 and, when the jaws 24 are displaced from the closed jaw position shown in FIG. 1 to the open jaw position shown in FIG. 2, with the jaw surfaces 28 in abutment with the guide surfaces 31 and with remaining jaw surfaces 25, 26 held in abutment with one another, the regions 32 will be taken-up in the space between the parts 11, 12 of the tool body 10. As a result of the described arrangement the guide surfaces 31 are so directed that upon movement of the surface 28 of each jaw 24 along an associated guide surface 31 the corner of said jaw defined by the surfaces 25, 26 thereof will move along a plane which extends parallel with said guide surfaces 31, which falls at right angles to the plane of the polygon and which extends through the geometric centre of gravity of said polygon. These planes are illustrated in chain lines at 33 in FIG. 2.

Figure 7:
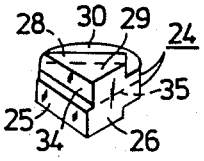
FIG. 7 is a perspective view of a modification of the crimping jaw illustrated in FIG. 6.

When crimping, for example contact sleeves onto electrical conductors with the aid of the illustrated tool, these contact sleeves obtain a square cross-section of the same cross-sectional area along the whole of the length thereof acted upon by the jaws 24. If different sectional areas are desired, the jaw surfaces 25 may be provided with recesses, as shown for example at 34 in FIG. 7. Alternatively, two groups of jaws can be arranged in side-by-side relationship, as indicated with the sectional plane 35 in FIG. 7, the jaws of the different groups slidingly abuting one another and each being guided in a respective one of the openings in the parts 11, 12.

It will be understood that crimping-opening cross-sections other than square can be obtained by changing the number and the shape of the jaws and the directions in which the guide surfaces 31 extend. For example, a crimping opening of elongated rectangular sectional shape can be obtained by using four crimping jaws and guide surfaces which together form a rhombic opening, while a crimping opening having a sectional shape in the form of a parallelogram can be obtained by using four crimping jaws and guide surfaces which together define a parallelogram-shaped opening. Similarly crimping openings of triangular, pentagonal and hexagonal shape can be obtained by using three, five and six jaws, respectively.

In the illustrated embodiment, the guide surfaces 31, projected onto the plane of the drawing, define a square and, by removing the corner portions of the lateral projections 29 in the regions 32, the jaw surfaces 28 have been made shorter than the guide surfaces 31. It is, of course, also possible to retain the aforementioned corner portions and to provide recesses accommodating said corner portions at the corners of the square, as illustrated at 36 in FIG. 2, wherewith the guide surfaces 31 and imaginary extensions thereof will form a square when projected onto the plane of the drawing.

Figure 3:
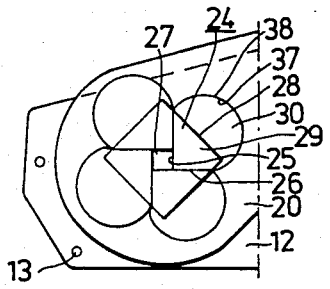
FIGS. 3 and 4 illustrate in side view the nose portion of the tool according to FIGS. 1 and 2 with the crimping jaws in the open and fully closed position, respectively, that part of the tool body nearest the viewer being removed to show more clearly the design of the crimping jaws and a cam means for activating the jaws.
Figure 4:
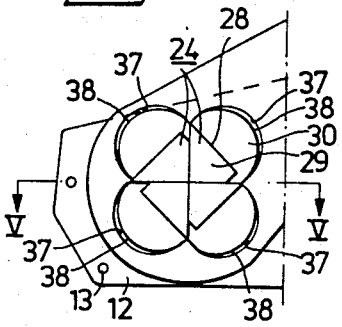
Figure 5:
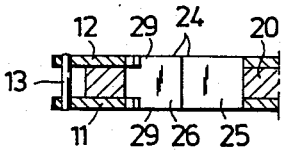
FIG. 5 is a sectional view taken on the line V—V in FIG. 4.
Figure 6:
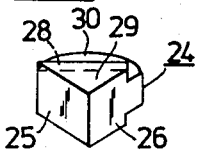
FIG. 6 is a perspective view of one of the crimping jaws illustrated in FIGS. 1–5.

In the space located between the parts 11, 12 of the tool body 10 the cam means 20 accommodates all jaws 24 in an opening defined by arcuate surfaces 37. These surfaces 37 form camming surfaces which are designed to co-act with arcuate surfaces 38 on the jaw portions 30 in a manner such that the jaws 24 are displaced parallel with an associated guide surface 31 upon rotation of the cam means 20. This rotation is produced by pivoting the handles 14, 15 towards and away from one another, and the effect produced by said cam surfaces 37 will be best seen from FIGS. 3 and 4, where the part 11 of the tool body 10 nearest the viewer has been removed. It will be seen that the cam means 20 is carried by the jaws 24.

In order to maximize the crimping force capable of being effected by the jaws 24, the stud 16 is mounted for movement in its transverse direction in a slot 39 located in the tool body 10. The stud 16 is normally held by the spring 23 in the end of the slot 39 located nearest the jaws 24. If the jaws 24 meet an excessively large resistance when pivoting the handle 15 towards the handle 14, the cam means 20 will remain stationary and the pivot stud 16 will instead move along the slot 39 away from the jaws 24, against the action of the spring 23, as illustrated in FIG. 8. The spring force therewith determines the crimping force exerted by the jaws 24. Alternatively, as indicated at 40 in FIG. 8, there may be distributed along the slot 39 a plurality of seats in which the stud 16 can be pre-placed in order to set a desired smallest dimension of the crimping opening 27.

The invention is not restricted to the embodiments described and illustrated in the accompanying drawings, but many modifications can be made within the scope of the concept of the invention defined in the following claims.

I claim:

1. A crimping tool comprising:

(a) a tool body having a jaw opening defined by a plurality of straight guide surfaces for slidably receiving a plurality of jaws movable relative to each other along said guide surfaces, said guide surfaces at least when extended intersecting each other to define a polygon having at least three sides; and (b) at least three abutting crimping jaws positioned for relative movement within said jaw opening to define a crimping opening, said jaws having straight first and second jaw surfaces that intersect each other at an angle and having third surfaces said first, second, and third surfaces of each jaw at least when extended intersecting each other to define a triangle, said first jaw surface defining edges of a crimping opening, said first jaw surface of each jaw slidably abutting said second jaw surface of an adjacent jaw, each of said third surfaces slidably abutting a respective one of said straight guide surfaces of said tool body with sliding movement of said third surfaces of said jaws relative to said straight guide surfaces causing relative sliding movement of abutting ones of said first and second jaw surfaces to change the size of said crimping opening, wherein the number of jaws is equal to the number of guide surfaces in said tool body, and wherein the intersection of said first and second jaw surfaces of each jaw defines a corner and each corner of a jaw moves along a plane that is parallel to the guide surface along which the third surface of that jaw slides, each said plane passing through the geometric center of the polygon defined by said guide surfaces and intersecting at right angles a plane in which said polygon lies.

2. A tool according to claim 1, wherein said guide surfaces define an equilateral polygon.

3. A tool according to claim 2, wherein said guide surfaces define a regular polygon.

4. A tool according to claim 1, wherein each of said third jaw surfaces has a length that is less than the length of the polygon side defined by the guide surface along which that jaw surface slides.

5. A tool according to claim 1, wherein said guide surfaces define a polygonal opening into which portions of said jaws project and upon which portions said third jaw surfaces are formed.

6. A tool according to claim 1, wherein the tool body includes a pair of laterally separated members which are positioned on respective opposite sides of the jaws and each of which members has an opening defined by guide surfaces for slidable engagement with said third jaw surfaces.

7. A tool according to claim 6, wherein each jaw has a third surface on each of two opposite sides thereof and an outwardly extending intermediate residual part extending between said members, said third surfaces being guided by a respective guide surface of each of the openings in the said members of the tool body.

8. A tool according to claim 1, wherein said first jaw surfaces include recesses to provide a crimp that presents regions of different sectional area.

9. A tool according to claim 6, comprising two groups of jaws arranged in side-by-side relationship, wherein said third surfaces of the jaws in one of said groups are guided by the guide surfaces of the opening in one of said members of said tool body and said third surfaces of the jaws in the other of said groups are guided by the guide surfaces of the opening in the other of said members of the tool body.

10. A tool according to claim 6, including cam means rotatably mounted between said members and having camming surfaces engageable with said jaws and surrounding the jaws for moving the jaws in unison.

11. A tool according to claim 9, including means rotatably mounted between said members and having camming surfaces engageable with said jaws and surrounding the jaws for moving the jaws in unison.

* * * * *